US005315842A

United States Patent [19]

Bolton et al.

[11] Patent Number: 5,315,842

[45] Date of Patent: May 31, 1994

[54] GRILLE MOUNT FOR ROOM AIR CONDITIONER

[75] Inventors: Theodore S. Bolton, Liverpool; Stephen Stopyra, Syracuse, both of N.Y.

[73] Assignee: Carrier Corporation, Syracuse, N.Y.

[21] Appl. No.: 27,029

[22] Filed: Mar. 5, 1993

[51] Int. Cl.[5] ..... F25D 23/12

[52] U.S. Cl. ..... 62/262; 62/298

[58] Field of Search ..... 62/262, 298; 454/201; 312/100, 236, 328; 285/921, 901

[56] References Cited

U.S. PATENT DOCUMENTS 4,607,500 8/1986 Bolton et al. ..... 62/262
4,633,770 1/1987 Taylor et al. .
5,046,406 9/1991 Harris et al. .
5,125,239 6/1992 Kobayashi et al. ..... 62/262

*Primary Examiner*—John M. Sollecito

[57] ABSTRACT

A unitary molded grill cover is provided for the indoor side of a window type air conditioner. The grille cover is installed without tools or fasteners. A transverse flange on the grille cover top wall is positioned into a groove or slot on the discharge deck, and the grille cover is snapped into place with the bottom wall thereof extending beneath the base pan of the unit. Bosses on the base pan project into corresponding holes in the grille cover bottom wall to retain the grille cover in place. The evaporator fan aperture plate and the discharge deck are also installed without tools or additional fasteners.

11 Claims, 2 Drawing Sheets

GRILLE MOUNT FOR ROOM AIR CONDITIONER

BACKGROUND OF THE INVENTION

This invention relates in general to room air conditioner, and is more specifically directed to a grille structure for the indoor portion of a window air conditioner unit.

Window type air conditioners typically have an indoor portion and an outdoor portion, the indoor portion being responsible for cooling and dehumidifying the indoor room air and the outdoor portion being responsible for exhausting heat into the outdoor environment. The indoor and outdoor portions each have a heat exchanger coil and a fan, and each has a return air opening and a discharge opening. A grille structure is normally installed at least over the indoor portion, and often grille structures are disposed over both the indoor and outdoor portions. To accommodate easy access to the internal parts of the unit (for cleaning or maintenance) the indoor section grille is made to be removable. Screws, clips or similar fasteners are used to attach the grille to the housing for the indoor portion. However, this construction, which requires separate fastener parts, makes construction of the unit somewhat difficult and requires undesirable process steps and parts inventory.

Additional parts also add cost and time to repair or maintenance procedures, and necessitate additional supply and inventory accounting.

An improved air conditioner window unit is described in Bolton et al. U.S. Pat. No. 4,607,500. There, a one-piece plastic molded grille is shown and described with recesses on the grille that engage flanges on the main air conditioner housing to permit the grille to be installed without separate fasteners.

Another window air conditioners unit is described in U.S Pat. No. 5,125,239 with a one-piece grille for its indoor portion. In that case, the grille is held in place with screws.

In either case, the total number of parts is high, as the discharge deck and the evaporator fan orifice plates requires separate fasteners. Also, the grilles on these units do not provide a tight fit without separate fasteners, and are not easily installed or removed except by trained personnel.

OBJECTS AND SUMMARY OF THE INVENTION

It is an object of this invention to provide improved air conditioner indoor grille and an improved method of mounting same so as to overcome the drawbacks of the prior art.

It is another object to provide an indoor portion grille which cooperates with a discharge deck and an evaporator fan orifice, to facilitate installation of these elements and to reduce the number of parts required.

In accordance with one aspect of this invention, an indoor portion of a room air conditioner has a base pan, a generally vertical partition, an evaporator coil situated in the base pan and generally parallel to the partition, and an evaporator fan, e.g. of the centrifugal type, which is situated between the partition and the evaporator coil. An evaporator plate is slid into place between the evaporator and the fan, and has a generally circular orifice directing air that passes through the evaporator coil into the fan. A fan chamber is defined between the orifice plate and the partition. This chamber can be shaped so as to diffuse the air that the evaporator or indoor fan discharges into the room. A discharge deck is formed as a unit and is positioned above the fan chamber. In one preferred version, the discharge deck has proximal and distal plate members that define a discharge opening to guide the conditioned air from the fan chamber out into the room. The proximal member rests upon an upper portion of the fan orifice plate and the distal member engages an upper hook flange of the partition. At this area of engagement the distal member also defines a lateral recess extending across it. An indoor grille cover has a top wall portion, a front wall portion and a bottom wall portion, as well as side wall portions. At the distal edge of the top wall portion is a depending flange that seats in the lateral recess mentioned just above. The front wall extends downwards from the proximal edge of the top wall and has a return air opening to admit room air into the evaporator coil. The bottom wall extends distally under the base pan from the lower edge of the front wall, and includes a releasable snap engagement construction to engage corresponding structure on the base pan. In the preferred embodiment, this can includes a pair of openings in the bottom wall and a corresponding pair of bosses that protrude into these openings when the grille cover is in place.

The top wall can have an opening that surrounds the top part of the discharge deck. The front wall can be formed of louvers or slats across the intake opening to give the grille an attractive appearance and to afford protection to the evaporator coil. Also, a removable air filter can be disposed between the grille and an intake side of the evaporator coil. The base pan, orifice plate, discharge deck and grille cover can all be molded of suitable plastic resins. The molded parts can thus be made to very close tolerance so that the various members that form the indoor portion fit together snugly without requiring fasteners such as screws, nuts, or clips. The parts can be assembled reliably and without requiring significant training on the part of the assemblers. Also, this construction permits rapid removal of the grille cover, and also of the discharge deck and orifice plate, if need be, for cleaning and maintenance of the indoor side of the unit.

The above and many other objects, features, and advantages of this invention will become apparent from the ensuing description of a preferred embodiment, which should be read in conjunction with the accompanying Drawing.

DETAILED DESCRIPTION OF THE PREFERRED EMBODIMENT

Figure 1:
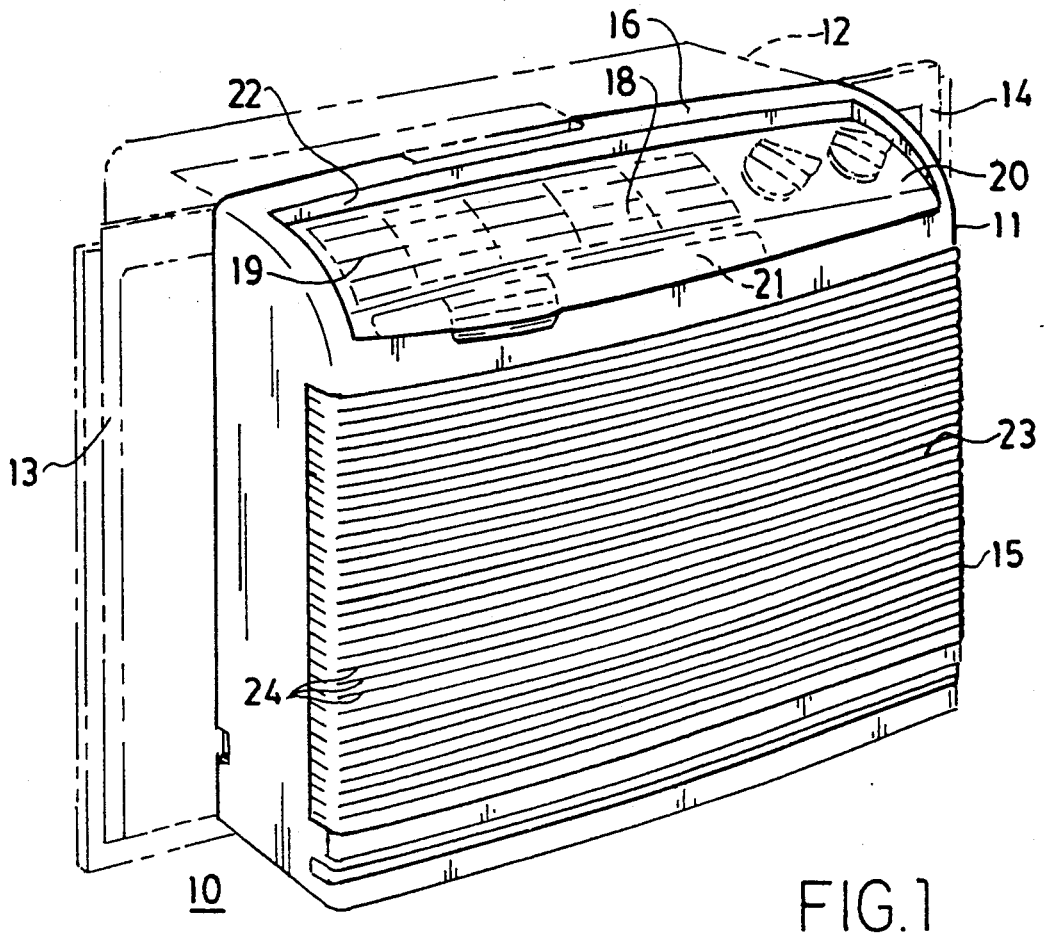
FIG. 1 is a perspective view of a portable window air conditioner unit which embodies the features of this invention.

With reference initially to FIG. 1, a portable window-type air conditioner unit 10 is formed of an indoor portion 11 and an outdoor portion 12. The unit is positioned on a window sill in a room where cooling is desired, with the indoor portion facing into the room. The window sash is closed onto the top of the unit 10, and left and right side curtains 13, 14 open outward to close the remaining window space.

Figure 2:
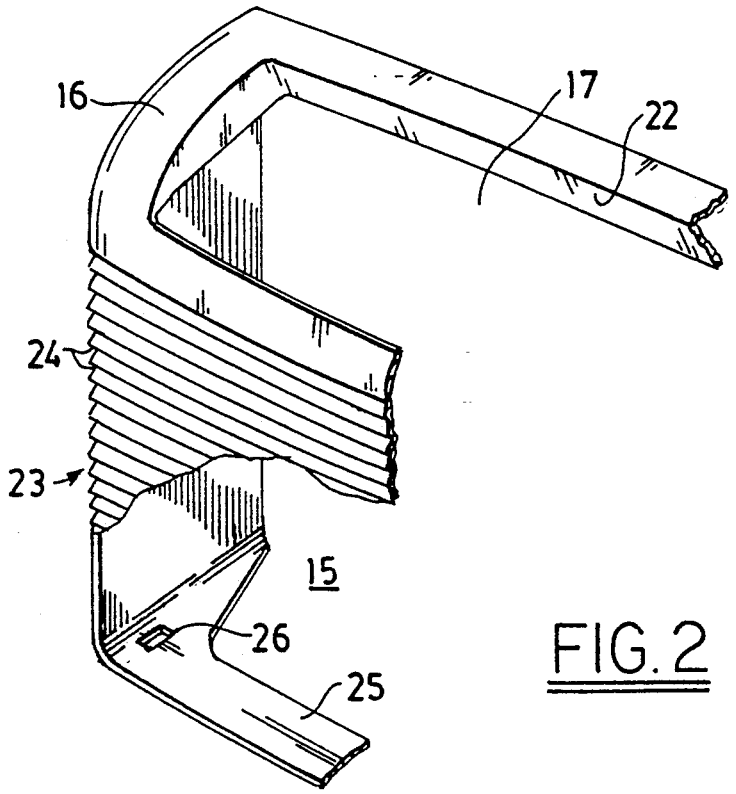
FIG. 2 is a partially cut-away perspective view of the indoor-side grille cover of this embodiment.

The indoor portion 11 here has a grille cover 15 which is a one-piece, molded plastic resin member, and which fits over the indoor portion 11. FIG. 2 shows the construction of this grille cover.

The grille cover 15 has a top wall portion 16 in which is formed an opening 17 to accommodate a discharge deck 18 (FIG. 1) which contains a lowered discharge zone 19. Alongside the latter is a control panel 20 with mode and temperature control knobs. The top portion or handle 21 of a removable air filter is also shown.

The top wall portion 16 has formed therein a rib or flange 22 that extends downward at a back edge of the opening 17; i.e. the ridge or flange 22 is disposed adjacent a distal edge of the top wall portion, and extends transversely. In this embodiment the flange 22 also extends forward along sides of the opening 17.

Extending downward from the top wall portion 16 is a front wall portion 23. This latter portion 23 contains a number of spaced, parallel ribs or slats 24 which define a return air opening in the front wall portion. At the base of the grill cover 15 is a bottom wall 25 that extends distally from a bottom edge of the front wall portion 23. A latch opening 26 is provided near each of the front corners of the bottom wall 25.

Figure 3:
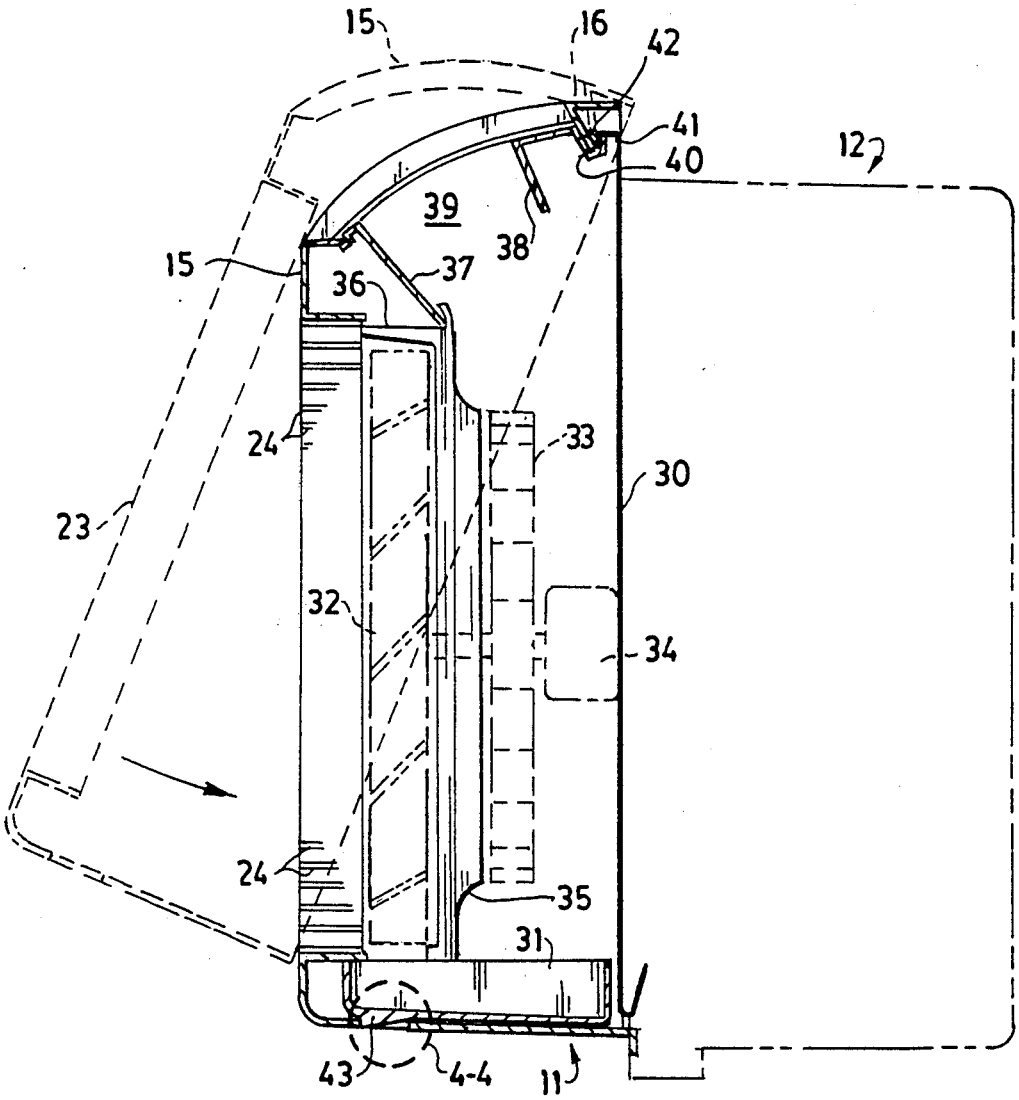
FIG. 3 is a sectional elevation of the indoor portion of the air conditioner unit of this embodiment, with an outline of the outdoor portion being shown in chain line, and the indoor-side grille cover also shown in ghost to illustrate the initial placement for installation.

FIG. 3 shows the general structure of the indoor portion 11 of the unit 10. A generally vertical partition 30 divides the indoor and outdoor portions of the unit, and a base pan 31 forms a base or bottom of the unit. An evaporator coil 32 rests at the front of the base pan 31 and rises therefrom. A centrifugal fan 33, whose drive motor 34 can be conveniently mounted in the partition 30, is positioned in a space between the evaporator coil 32 and the partition 30. The bottom wall 25 of the grille cover 15 here can have curved side edges that rise to remain adjacent to similarly curved sides of the base pan 31.

A molded, one-piece evaporator fan aperture plate 35 is positioned between the evaporator coil 32 and the fan 33. The plate 35 is generally disposed vertically, but has an upper horizontal ledge 36 that projects forward above the top of the coil 32. This aperture plate 35 has a fan aperture or opening which channels return air that passes through the coil 32 into the fan 33, which drives the air into a fan chamber that is defined between the partition 30 and the aperture plate 35.

As is also shown in FIG. 3, the discharge deck 18 is positioned above the fan chamber, and has front and back wall members 37 and 38 that define a discharge opening 39 that directs cooled and dehumidified air back into the room. A bottom edge of the front wall member rests upon the evaporator fan aperture plate 35 on the ledge 36, and holds orifice plate in place. The back wall 38 is joined to a hook or channel portion 40 that fits into a corresponding hook flange 41 formed at the top edge of the partition 30.

These two elements 40, 41 combine to define a slot 42 that extends transversely along the distal edge of the discharge deck 18 and receives the rib or flange 22 of the grille cover 15.

To install the grille cover, the flange 22 is positioned in the slot 42 with the grille cover 15 oriented as shown in broken lines in FIG. 3. Then, the grille cover is rocked into place, moving in the direction of the arrow, to the solid-line position, with the bottom wall 25 fitting snugly against the lower surface of the base pan 31.

Figure 4:
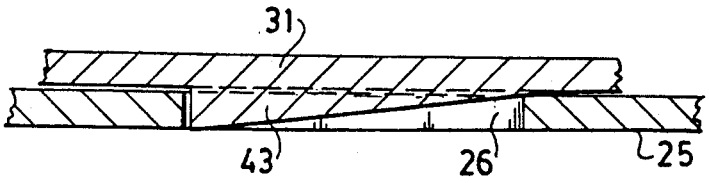
FIG. 4 is a detail view of a portion 4—4 of FIG. 3.

As shown with additional references to FIG. 4, a boss or protuberance 43 is formed at each front corner of the base pan, and this protrudes into the respective latch opening 26 in the grille cover bottom wall 25. In this manner, a snug snap-fit is attained, so that the grille cover is held securely but removably, without resort to screws, bolts, clips, nuts, or other separate fastener means.

The grille cover also holds the discharge deck 18 in place, which as mentioned previously holds the aperture plate 35 in place. Thus, assembly of the indoor portion of the unit is greatly facilitated, as no separate fasteners are required for these parts, nor are tools required for assembly. The grille cover, discharge deck, and aperture plate can also be removed easily to facilitate cleaning, service or routine maintenance.

If additional fastening of the discharge deck is desired, the same can be secured by means of a single machine screw which can be concealed below one of the knobs on the control panel 20.

The bosses 43 can alternatively be formed on side surfaces of the base pan 31, with the latch opening being disposed in registry therewith on sides of the grille cover adjacent the bottom wall portion. The latch openings can be depressions in the grill cover interior, or can penetrate through the grille cover as shown here.

Also in place of the bosses 43 and openings 26, alternative snap-fastening means could be conveniently incorporated into the grille cover 15 and base pan 31.

While this invention has been described with reference to a single preferred embodiment, it should be recognized that the invention is not limited to that precise embodiment. Rather, many modifications and variations would present themselves to those skilled in the art without departing from the scope and spirit of this invention, as defined in the appended claims.

What is claimed is:

1. An indoor side grille for a window air conditioner unit that includes on its indoor portion a base pan extending generally horizontally at a base of the unit and a discharge deck disposed at an upper side of the unit indoor portion and having a lateral recess extending therealong; the grille comprising a top wall having a flange extending along a distal portion of the top wall to engage the lateral recess of the discharge deck; a front wall depending from a proximal edge of the top wall, the front wall having a return air opening formed therein to admit intake air into said unit indoor portion; and a bottom wall portion that extends distally beneath said base pan from a lower edge of said front wall, said bottom wall portion including releasable snap engagement means for releasably latching onto corresponding means provided on said base pan, such that said grille is installed on said unit indoor portion without additional fasteners by engaging said flange in said recess, and swinging said grille into place until the snap engagement means on said bottom wall portion latch onto the corresponding means on said base pan, wherein said top wall is provided with a discharge deck opening which fits around the discharge deck, the flange defining a back wall of said discharge deck opening.

2. The indoor side grille of claim 1 wherein said flange also extends along side edges of said discharge deck opening.

3. An indoor side grille for a window air conditioner unit that includes on its indoor portion a base pan extending generally horizontally at a base of the unit and a discharge deck disposed at an upper side of the unit indoor portion and having a lateral recess extending therealong; the grille comprising a top wall having a rib extending along a distal portion of the top wall to engage the lateral recess of the discharge deck; a front wall depending from a proximal edge of the top wall, the front wall having a return air opening formed therein to admit intake air into said unit indoor portion; and a bottom wall portion that extends distally beneath said base pan from a lower edge of said front wall, said bottom wall portion including releasable snap engagement means for releasably latching onto corresponding means provided on said base pan, such that said grille is installed on said unit indoor portion without additional fasteners by engaging said rib in said recess, and swinging said grille into place until the snap engagement means on said bottom wall portion latch onto the corresponding means on said base pan, wherein said engaging mean son said bottom wall portion includes a hole in a predetermined position in said bottom wall portion, and the associated corresponding means includes an embossment at a corresponding position in said base pan and which protrudes into said hole to retain the grille in place.

4. The indoor side grille of claim 3 further comprising left and right side walls at left and right edges respectively, of said top wall, front wall, and bottom wall portion.

5. The indoor side grille of claim 3 wherein said grille is unitarily formed.

6. A window air conditioner unit of the type having indoor and outdoor portions, with a generally vertical partition dividing the unit into said indoor and outdoor portions, the indoor portion comprising a generally horizontal base pan; an evaporator coil disposed in said base pan generally proximal of said partition; a centrifugal fan situated between said partition and said evaporator coil; an evaporator fan orifice plate disposed between said evaporator coil and said fan to define a fan chamber between said orifice plate and said partition, with an opening to admit return air passing through said evaporator coil to said fan; a discharge deck positioned above said fan chamber having a discharge opening to exhaust air from said fan chamber, said discharge deck having a proximal member which rests upon an upper portion of said fan orifice plate and a distal member which engages an upper portion of said partition, said distal member defining a lateral recess extending thereacross; and an intake side grille which includes a top wall having a lateral rib extending along a distal portion thereof to engage the lateral recess of said discharge deck; a front wall depending from a proximal edge of said top wall, the front wall having a return air opening formed therein to admit return room air into said evaporator coil, and a bottom wall that extends distally beneath said base pan from a lower edge of said front wall; said bottom wall including releasable snap engagement means for releasably latching into corresponding means provided on said base pan;

such that said grille is installed on said unit indoor portion without additional fasteners by engaging said rib in said recess and swinging said grille into place until the snap engagement means on said lower wall latch onto the corresponding means on the base pan.

7. A window air conditioner unit of the type having indoor and outdoor portions, with a generally vertical partition dividing the unit into said indoor and outdoor portions, the indoor portion comprising a generally horizontal base pan; an evaporator coil disposed in said base pan generally proximal of said partition; a centrifugal fan situated between said partition and said evaporator coil; an evaporator fan orifice plate disposed between said evaporator coil and said fan to define a fan chamber between said orifice plate and said partition, with an opening to admit return air passing through said evaporator coil to said fan; a discharge deck positioned above said fan chamber having a discharge opening to exhaust air from said fan chamber, said discharge deck having a proximal member which rests upon an upper portion of said fan orifice plate and a distal member which engages an upper portion of said partition, said distal member defining a lateral recess extending thereacross; and an intake side grille which includes a top wall having a lateral rib extending along a distal portion thereof to engage the lateral recess of said discharge deck; a front wall depending from a proximal edge of said top wall, the front wall having a return air opening formed therein to admit return room air into said evaporator coil, and a bottom wall that extends distally beneath said base pan from a lower edge of said front wall; said bottom wall including releasable snap engagement means for releasably latching into corresponding means provided on said base pan; such that said grille is installed on said unit indoor portion without additional fasteners by engaging said rib in said recess and swinging said grille into place until the snap engagement means on said lower wall latch onto the corresponding means on the base pan, wherein said engaging means on said grille bottom wall includes a hole in a predetermined position in said bottom wall and the associated corresponding means includes an embossment at a corresponding position in said base pan and which protrudes into said hole to retain the grille in place.

8. The window air conditioner unit of claim 7, wherein said grille is unitarily molded of a plastic resin.

9. The window air conditioner unit of claim 7 said grille further including left and right side walls disposed at left and right edges respectively of said top front and bottom walls.

10. A window air conditioner unit of the type having indoor and outdoor portions, with a generally vertical partition dividing the unit into said indoor and outdoor portions, the indoor portion comprising a generally horizontal base pan; an evaporator coil disposed in said base pan generally proximal of said partition; a centrifugal fan situated between said partition and said evaporator coil; an evaporator fan orifice plate disposed between said evaporator coil and said fan to define a fan chamber between said orifice plate and said partition, with an opening to admit return air passing through said evaporator coil to said fan; a discharge deck positioned above said fan chamber having a discharge opening to exhaust air from said fan chamber, said discharge deck having a proximal member which rests upon an upper portion of said fan orifice plate and a distal member which engages an upper portion of said partition, said distal member defining a lateral recess extending thereacross; and an intake side grille which includes a top wall having a lateral flange extending along a distal portion thereof to engage the lateral recess of said discharge deck; a front wall depending from a proximal edge of said top wall, the front wall having a return air opening formed therein to admit return room air into said evaporator coil, and a bottom wall that extends distally beneath said base pan from a lower edge of said front wall; said bottom wall including releasable snap engagement means for releasably latching into corresponding means provided on said base pan; such that said grille is installed on said unit indoor portion without additional fasteners by engaging said flange in said recess and swinging said grille into place until the snap engagement means on said lower wall latch onto the corresponding means on the base pan, wherein said grille top wall is provided with a discharge deck opening which fits around said discharge deck, and said flange defines a continuous back wall of said discharge deck opening.

11. The window air conditioner unit of claim 10 wherein said flange also continues along side edges of said discharge deck opening.

* * * * *